US006352262B1

(12) United States Patent
Looney

(10) Patent No.: US 6,352,262 B1
(45) Date of Patent: Mar. 5, 2002

(54) METHOD OF CONDUCTING SIMULTANEOUS GAMEPLAY USING STACKABLE GAME PIECES

(76) Inventor: Andrew J. Looney, P.O. Box 761, College Park, MD (US) 20740

( * ) Notice: Subject to any disclaimer, the term of this patent is extended or adjusted under 35 U.S.C. 154(b) by 18 days.

(21) Appl. No.: 09/627,560

(22) Filed: Jul. 28, 2000

(51) Int. Cl.[7] ..... A63F 3/00

(52) U.S. Cl. ..... 273/290; 273/291; 273/288; 273/282.1

(58) Field of Search ..... 273/291, 290, 273/288, 282.1, 282.2, 282.3

(56) References Cited

U.S. PATENT DOCUMENTS 2,485,143 A * 10/1949 Duncan ..... 273/290
2,743,107 A * 4/1956 Hollossy ..... 273/290
4,936,585 A 6/1990 Looney et al.
5,209,486 A * 5/1993 Brotz ..... 273/290
5,318,305 A * 6/1994 LoCoco ..... 273/258
5,839,727 A * 11/1998 Stillinger ..... 273/271
6,189,887 B1 * 2/2001 Dommasch ..... 273/260

* cited by examiner

*Primary Examiner*—Benjamin H. Layno

(57) ABSTRACT

A strategy game utilizing a stackable playing piece. Each player is assigned a multiplicity of such playing pieces, which begin the game standing individually in a random arrangement on a featureless playing field. During the course of the game, players stack the pieces up on one another, forming them into towers. Other game actions permit players to move pieces from one tower to another, and to divide larger towers into pairs of smaller towers. Participants may conduct these game actions at any time they choose, without adhering to any turn order. Play continues until no more game actions can or will be made. The object of the game is to be the player with the top piece on as many towers as possible, since points are awarded for each piece in a tower to the player who's piece is on top. The winner is the player with the highest total score.

3 Claims, 2 Drawing Sheets

METHOD OF CONDUCTING SIMULTANEOUS GAMEPLAY USING STACKABLE GAME PIECES

FIELD OF THE INVENTION

This invention relates to a parlor game played by two or more participants.

The invention consists of a method of stacking and re-stacking playing pieces in a free-form board game that can be played without turns.

DISCUSSION OF PRIOR ART

In U.S. Pat. No. 4,936,585, issued Jun. 26, 1990, Looney and Cooper teach a method of manipulating and interpreting playing pieces that permits simultaneous play by all participants and which requires no game board, only a few minor delineations of the playing field. The game was called Icehouse, and in the preferred embodiment, it was played with small pyramids of 3 sizes, 15 per player as depicted in FIG. 2 of their patent.

In the ten years since that patent was issued, game sets embodying this invention have been sporadically published and sold by the inventors. However, even though the original game has developed a certain dedicated following, it has a number of flaws that have driven the inventors to develop other games that can also be played with the game pieces described in their patent. Many such games have since been invented, but most of them invoke additional equipment, such as a chessboard, playing cards of various types, or dice. Few of these newer games have held to the elegance of employing no other equipment, and thus being playable on any available flat surface. Most importantly, none of these other games have permitted simultaneous play by all participants, as seen in the original game described in the Looney/Cooper patent.

In addition, prior to this invention, all Icehouse sets featured solid pyramidal game pieces, as depicted in FIG. 1 of U.S. Pat. No. 4,936,585. This was always considered the optimal form of the playing piece, since a weightier game piece is more tactilely satisfying and less prone to jostled placement than a lightweight, hollow piece would be.

The issue of jostled placement is one of the design flaws in the original game. Due to the precision alignment of pieces on the playing field required by that method, a bump of the table or a collision of pieces during play could easily, and unfairly, alter the course of the game. Rules were devised to counter this factor, but these often just put clumsy players (i.e. those without good hand-eye coordination) at an even greater disadvantage. Moreover, even a fairly small jostling of pieces could be uncorrectable, forcing a premature end to the entire game.

Other factors as well made Icehouse an imperfect embodiment of the original vision of a free-form, simultaneous-play abstract strategy game. While the delineations of the playing area were fairly minimal, they were not non-existent; this made additional equipment necessary, in the form of markers, depicted as item 22 in FIG. 2 of U.S. Pat. No. 4,936,585. This solution was not only inelegant but also the cause of numerous disputes over questionably legal plays. The abuse potential of some of these rules necessitated a special section in the game instructions that branded deliberate exploitation of loopholes "uncool" and extolled the virtues of "cool" playing styles instead. Finally, the scoring system was complex and error-prone. All of these factors combined to make the game described in U.S. Pat. No. 4,936,585 an unlikely candidate for widespread commercial success, despite its fascinating and unique mechanisms.

SUMMARY OF THE INVENTION

This invention is an improvement over the prior art in several important ways. It begins with a redesigned game piece, one with the same outer dimensions (therefore being compatible with existing game sets), but hollow, with an opened base. Ideally, the walls will be of sufficient thickness to provide adequate piece heft while also being thin enough to allow several pieces of different sizes to fully nest, one within the next, like a set of Matryoshka (Russian stacking dolls). When the pieces are instead stacked up, with equal or smaller sized pieces only being played on top of other pieces, they will form into towers in which each piece in the stack can easily be seen and identified. This stacking structure, made possible by the described improvement to the game piece, provides the basis for a fast and exciting strategy game when combined with the method of play contained in this invention.

This game has been given the name IceTowers. While bearing little resemblance to the original game Icehouse, this new game improves on its predecessor in many ways: it is easier to learn and faster to play; it uses a truly free-form playing field, eliminating the need for "unplayed piece" areas by putting all pieces into play at all times; when accidents do happen, recovery is much easier than in the original game, eliminating the need for punishment of clumsy players; precise placement of pieces too has been removed as a factor; calculating the score at the end is comparatively easy and mistake-proof; there are fewer loopholes to exploit, and fewer rules in general to learn; and yet, it still manages to provide the same sort of real-time strategy game thrills that made the original game so compelling.

In this invention, each player is assigned a multiplicity of playing pieces which are distinguishable in color, composition, or external markings, or in some other visual manner, from the playing pieces of his or her opponents. The playing pieces will be of varying but similar appearances, preferably pyramids or cones of several different sizes. The size differences within color groups will be used as the basis for awarding points for pieces controlled at game's end, with markings on the pieces being used to remind players of these point values; but other point-assignment means could be used as well. The pieces will have an opening at their base such that each may be stacked on top of one another, with larger pieces preferably being able to completely enclose smaller pieces, but with multiple stacked pieces forming into towers, with each piece visible, whenever pieces are stacked only onto other equal or larger-sized pieces.

The playing area will be a featureless open field. Setting up the game is as simple as scattering the pieces onto the playing area and standing them all upright where they lie. Each player is then assigned all pieces of a particular color (or other visual distinction), and upon a mutually agreed upon signal, the game begins.

The game is played by allowing all participants to interact with the playing pieces in any of several different ways, as restricted by the game's rules, at the same time as the other players but moving at whatever rate of play the individual player chooses. The methods of interaction, which will be referred to by the names Capping, Mining, and Splitting, will cause the individually placed game pieces to form into a set of towers, of an unpredictable number and of varying heights. The game will continue until no more interactions are possible under the rules of play, or until all players agree no more changes will be made to the current configuration of game pieces. Points are then awarded to each player, as determined by the assigned values of the pieces in all towers controlled by each player, where control of a tower is determined by the color of the piece on top of the tower. The winner will be the player with the highest total score.

DESCRIPTION OF THE INVENTION

Figure 1:
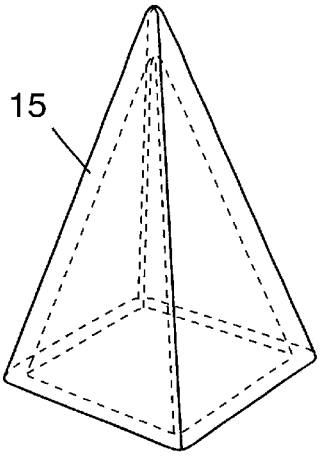
FIG. 1 is a pictorial representation of the basic playing piece used in the preferred embodiment of the game.

FIG. 1 depicts the basic playing piece of this invention in its preferred form, a pyramid 15. As shown, pyramid 15 will be hollow, with an opening at the base.

Figure 2:
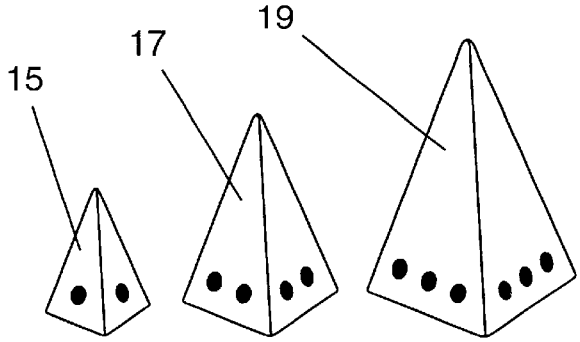
FIG. 2 depicts the basic playing piece in several different sizes, with point values indicated by small marks along the bottom edge.

FIG. 2 depicts the basic pyramid 15 with two larger pyramids, 17 and 19. The size differences between the three types of game pieces should be visually obvious, though marks may be added as shown to further clarify the size differences. These marks will also denote the value of the piece during the score-keeping phase. In the preferred embodiment, each player will be assigned five each of pyramids 15, 17, and 19, all of a single color.

Figure 3:
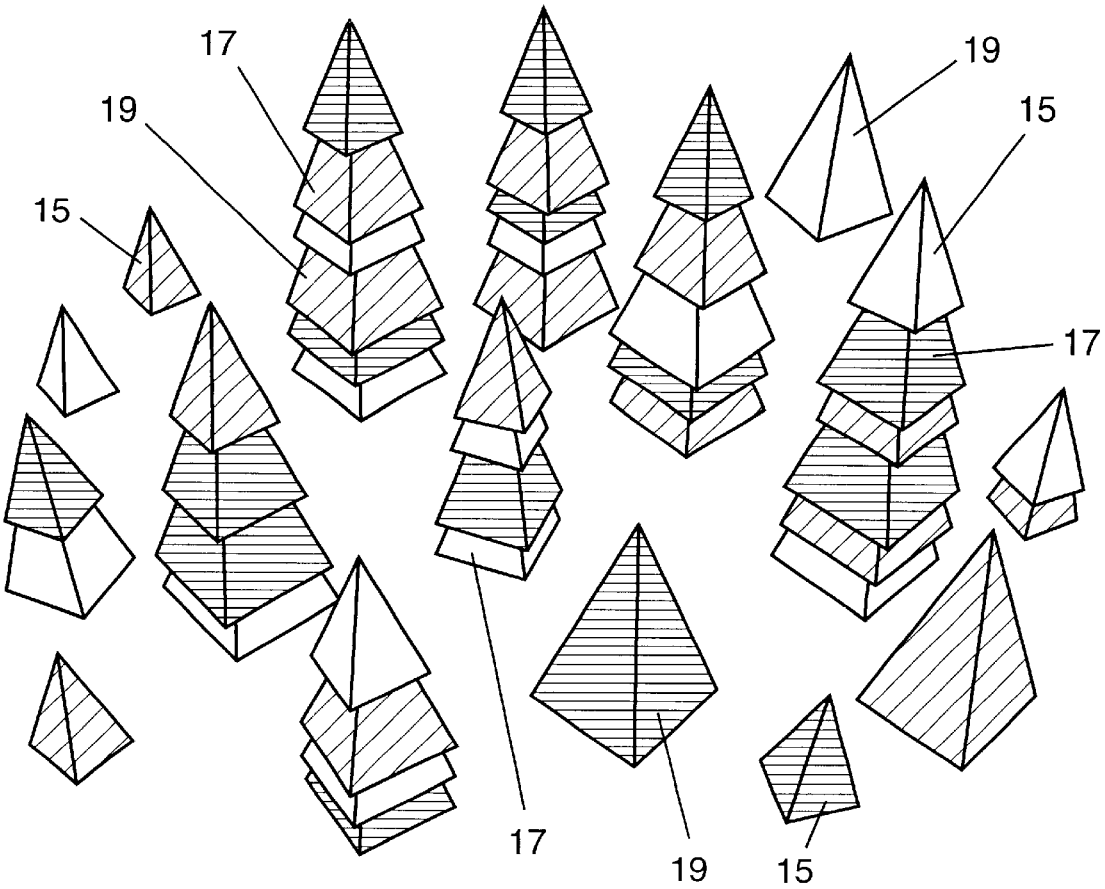
FIG. 3 is a detailed perspective view depicting the game elements in a possible configuration during the game.

FIG. 3 depicts the invention in a typical configuration. Pyramids 15, 17, and 19 are shown in three different colors, one assigned to each of three active players. This figure depicts a game in-progress; at the beginning, all pieces were standing alone, but many have now been built up into towers, as shown. Play will continue until no single pieces remain unstacked, and all other options for changing the arrangement of pieces within the towers have been exhausted. At that time, the score will be taken, with points being awarded for each tower, to the player who owns the piece on top of the tower.

Figure 4:
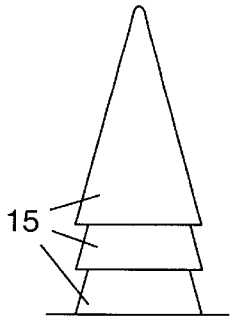
FIGS. 4–6 are simple side views showing how different combinations of game pieces will stack and nest.
Figure 5:
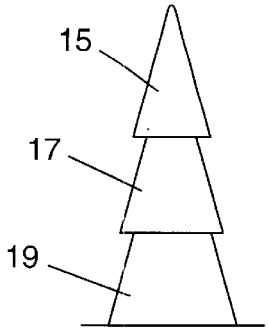
Figure 6:
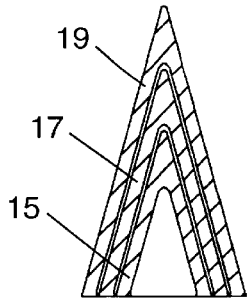

To be completely clear about how the game pieces can be stacked and nested, FIGS. 4–6 show all three cases. FIG. 4 depicts stacking of towers of equal-sized pieces; FIG. 5 depicts smaller pieces stacked onto larger pieces; and FIG. 6 shows how smaller pieces can fit fully inside larger pieces.

OPERATION OF THE INVENTION

To begin, randomly arrange the game pieces on the playing field, each alone and standing upright. Assign a color to each player. On a mutually agreed upon starting signal, the game will begin, with all players being allowed to conduct game actions at whatever rate they choose, rather than waiting and taking turns. The range of allowable actions will include Capping, Mining, and Splitting, as defined below.

Figure 7A:
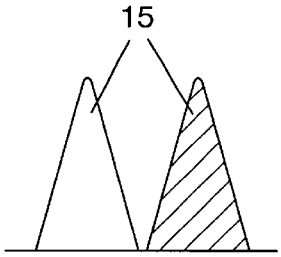
FIGS. 7–9 are before-and-after side views depicting examples of the play options referred to herein as Capping, Mining, and Splitting.
Figure 7B:
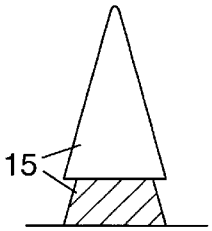

FIG. 7 depicts the most common action in the game, called Capping. This is the placing of one player's piece onto a piece that belongs to another player, thus either forming a tower with a height of two, or increasing the height of an existing tower by one. A player may only pick up and move a piece of his or her own color, and then only if it's standing alone. A player may only place a piece on top of another piece when the two pieces are of different colors and the piece being played is either the same size or smaller than the size of the piece being capped. FIG. 7A shows a typical capping situation before the play is made; FIG. 7B depicts the same two pieces afterwards.

Figure 8A:
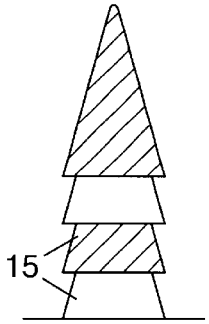
Figure 8B:
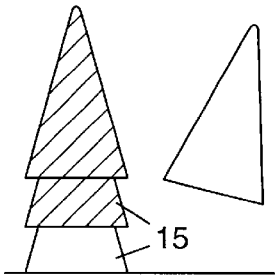

FIG. 8 depicts another play option, called Mining. Whenever a player has two or more pieces in a single tower, excluding the piece on top, that player may open up the stack and remove a piece of his or her choice. The tower should immediately be reassembled, after which the piece just removed should next be played, onto a tower other than the one just mined. FIG. 8A shows a typical mining situation; in this case, either of the unshaded pieces may be removed (but since the tower is topped by a shaded piece, neither of the shaded pieces are mineable). FIG. 8B depicts the same situation, after an unshaded piece has been mined. The piece is now in the owner's hand; as described below, it must immediately be used to cap another tower, if possible.

Figure 9A:
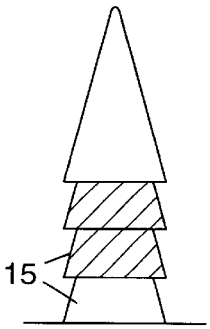
Figure 9B:
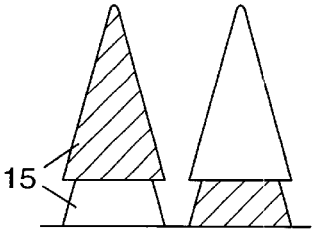

FIG. 9 depicts the final play option, called Splitting. Whenever two pieces of one color are next to each other in a tower, any player other than the owner of the two same-colored pieces may split the tower in two, by separating the pair of same-colored pieces. FIG. 9A shows a typical opportunity for a tower split; FIG. 9B depicts the same situation afterwards. The tower has become two towers; the first tower is topped by the lower of the pair of same-colored pieces, while the second tower has the upper of those pieces on the bottom. (Note that since a player cannot do this to one's own pieces, the game may end with some towers remaining unsplit.)

Some additional restrictions will be in force. Players will be restricted in their use of two-handed playing. While it will be sometimes necessary to use both hands (notably when mining), players should not attempt to conduct more than one play option at one time by using both hands. Also, as noted, when a piece is removed through mining, it must immediately be used to cap a different tower. If no legal plays are available, the piece must be set down in the open. (As a note on game etiquette, it's acceptable for a player to take a moment to examine his or her options, but the player is expected to then come to a decision and play the piece. One cannot sit holding onto a mined piece, waiting until a more appealing place to play it becomes available; indeed, other players may insist that the piece be played before they take their next actions.)

The game ends when all players agree that no more plays will be made. Often this will happen unambiguously, when no more moves are possible, but in many cases the players will need to agree that the game is over, since not all splitting opportunities will be taken advantage of. Also, in the very final stages of the game, a player may find himself with an unplayed piece in hand and nowhere attractive to put it. If there is another player in the same situation, neither player will want to set down this final piece they hold, for fear of it being immediately capped by the other player. In this case, the game is called and these players will just set their pieces down.

When the game is recognized as being over, all players should locate the towers topped by pieces of their assigned colors, and move them to one side for scoring. Points are awarded according to the point values assigned to each of the pieces in the towers. The player with the highest total score will be declared the winner.

SUMMARY, REFLECTIONS, AND SCOPE

By redesigning the Icehouse game piece to stack and nest as shown here, many new game design options have been added to an already versatile set of gaming equipment. The method described above takes advantage of this new feature by also providing a completely new system for playing an abstract strategy game which, like the method described in U.S. Pat. No. 4,936,585, is not limited by the need to take turns nor requiring of any rigid gameboard, but which surpasses the original game in terms of ease, elegance, and accessibility.

Figure 10:
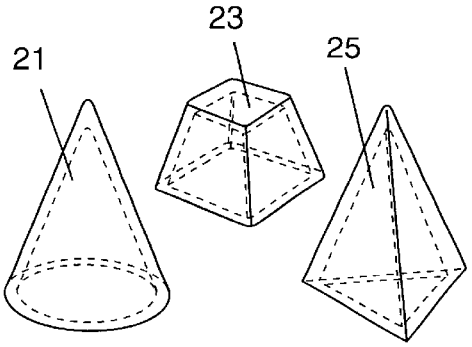
FIG. 10 depicts several possible alternate embodiments of the basic playing piece used in this invention.

While the above description contains many specifities, these should not be construed as limitations on the scope of the invention, but rather as an exemplification of one preferred embodiment thereof. Many other variations are possible. For example, this method could equally well be applied to a set of game pieces with other shapes, so long as they permit the stacking operations required by this mechanism. FIG. 10 depicts three other possible game piece designs: cone 21, sloping box 23, and three-sided pyramid 25. Other forms are also possible. Similarly, instead of providing the basic game piece in just three sizes, four or five distinctions could be made. Yet more piece distinctions are possible, by providing additional markings on the pieces, with other values than the simple point-based pip system shown in FIG. 2. Finally, the ruleset described here could easily be extended to include additional options for added excitement. For example, other rules for making adjustments to the order of the playing pieces within the towers could be added to this mechanism.

The game is best when played by three or more players, but it can be modified to accommodate fewer participants. Special rules can be added, allowing each person player to control two colors at the same time, proceeding as if additional players were involved. Similarly, a solitaire game and many other variations based on this mechanism are possible. The game could even be played with a turn order, if desired. However, the system of stacking pieces described herein would still be the basis of the game. Thus, the scope of the invention should be determined by the appended claims and their legal equivalents, rather than by the examples given.

I claim:

1. A method of playing a board game of skill and strategy comprising the steps of:

(a) providing a plurality of playing pieces for each player, said playing pieces being visually distinguishable from those of other players, and of such a shape as to permit the stacking of one onto another such that multiple pieces can be stacked up into towers, with all pieces within remaining visible, (b) providing an open playing area accessible by all players, and setting up said playing pieces in said playing area, each one standing alone, (c) manipulating said playing pieces such that players may stack one upon the next to form towers, or move said pieces from one of said towers to another, or divide said towers in two, or otherwise rearrange said pieces within said towers, continuing until no more such manipulations can or will be made by the players, (d) deriving a score for each player by awarding points to each player for each tower controlled by said player, where control is determined by examining the top piece in each tower, (e) identifying the winner by comparing the total points awarded to each player.

2. The method of deriving a score of claim 1 wherein different point values are associated with differences in the appearance of the playing pieces.

3. The method of manipulating playing pieces of claim 1 wherein players may make plays at any time they choose.

* * * * *